US006971327B2

(12) United States Patent
Mattson

(10) Patent No.: US 6,971,327 B2
(45) Date of Patent: Dec. 6, 2005

(54) CONCRETE MODULE FOR FLOATING STRUCTURES AND METHOD OF CONSTRUCTION

(76) Inventor: Jerry L. Mattson, 15 Old Erie Rd., Lake Ozark, MO (US) 65049

( * ) Notice: Subject to any disclaimer, the term of this patent is extended or adjusted under 35 U.S.C. 154(b) by 0 days.

(21) Appl. No.: 10/800,842

(22) Filed: Mar. 15, 2004

(65) Prior Publication Data

US 2004/0182300 A1 Sep. 23, 2004

Related U.S. Application Data

(60) Provisional application No. 60/455,283, filed on Mar. 17, 2003.

(51) Int. Cl.[7] ..... B63B 35/44
(52) U.S. Cl. ..... 114/266; 114/267
(58) Field of Search ..... 114/263, 264, 266, 114/267; 405/219

(56) References Cited

U.S. PATENT DOCUMENTS

| | | | | |
|---|---|---|---|---|
| 3,091,203 | A | 5/1963 | Usab | |
| 3,128,737 | A | 4/1964 | Usab | |
| 3,221,696 | A * | 12/1965 | Gardner | 114/266 |
| 3,546,773 | A | 12/1970 | Gerstin | |
| 3,799,093 | A | 3/1974 | Thompson | |
| 4,265,193 | A | 5/1981 | Sluys | |
| 4,318,361 | A | 3/1982 | Sluys | |
| 4,318,362 | A | 3/1982 | Jung | |
| 4,321,882 | A | 3/1982 | Sluys | |
| 4,365,914 | A | 12/1982 | Sluys | |
| 4,406,564 | A | 9/1983 | Hanson | |
| RE31,984 | E | 9/1985 | Sluys | |
| 4,693,631 | A | 9/1987 | McKay | |
| 4,709,647 | A | 12/1987 | Rytand | |
| 4,715,307 | A | 12/1987 | Thompson | |
| 4,733,626 | A * | 3/1988 | Svirklys et al. | 114/267 |
| 4,887,654 | A | 12/1989 | Rytand | |
| 4,940,021 | A | 7/1990 | Rytand | |
| 4,947,780 | A | 8/1990 | Finn | |
| 5,044,296 | A | 9/1991 | Finn | |
| 5,050,524 | A | 9/1991 | Kyhl et al. | |
| 5,107,785 | A | 4/1992 | Baxter | |
| 5,129,347 | A * | 7/1992 | Hill | 114/266 |
| 5,215,027 | A | 6/1993 | Baxter | |
| 6,199,502 | B1 | 3/2001 | Mattson | |

* cited by examiner

*Primary Examiner*—Lars A. Olson
(74) *Attorney, Agent, or Firm*—Chase Law Firm, L.C.

(57) ABSTRACT

A concrete module having a buoyant center core with a light weight concrete outer shell. The modules have lengthwise and width wise passages on non-common planes. The modules are connected with rods, cables or other interconnecting methods through the passages. The sides of the modules may be curved to allow the modules to fit securely together along the vertical corners in a straight line without bowing or bending. The top of the module may be constructed with reinforcing ribs for strength. The size of the modules are designed to be transported using standard hauling trucks and moved with skid loaders or fork lifts. The modules have common sizes and connecting passages between modules to make uniform modules to allow custom designed docks and other floating structures to be configured. A variety of brackets are provided for attaching other structures to the modules making up the floating structure.

29 Claims, 9 Drawing Sheets

CONCRETE MODULE FOR FLOATING STRUCTURES AND METHOD OF CONSTRUCTION

CROSS REFERENCE TO RELATED APPLICATION

This application claims the benefit of a prior filed, now abandoned provisional application Ser. No. 60/455,283, filed Mar. 17, 2003, entitled CONCRETE MODULE FOR FLOATING STRUCTURES AND METHOD OF CONSTRUCTION.

BACKGROUND OF THE INVENTION

The present invention relates to floating structures and methods of constructing floating structures and, more particularly, to a concrete module for floating structures and a method of constructing the structures and the modules.

Floating structures, such as docks, decks, wharfs, breakwater, floating walkways, boat slips and other structures are generally known in the art. These structures may be constructed of wood or other buoyant material that allows the structure to float in water. One problem with these relatively light weight structures is they are not durable and are prone to excessive movement on rough waterways.

Other floating structures have been proposed using concrete modules with a concrete shell over a hollow center core or float. The modules of these structures typically flex or bow with respect to each other resulting in an unstable platform and incur damage along the modules' edges from the movement. These structures often have gaps or spaces between the modules that must be filled or otherwise maintained.

The connecting passages through some of the prior art floating concrete modules include metal lines or tubes embedded in the concrete to provide passages through the module for the interconnecting cable, chain or rod. The metal lines or tubes often rust or react with the interconnectors. Electrolysis also may occur due to the dissimilar metals of the liner and the interconnectors causing the cables, rods, or chains to rust, weaken and eventually break. Other structures do not allow a practical way to attach a roof structure, rails, boat lift brackets, cable attaching brackets, and stiff arm brackets, to the main frame of the dock structure.

SUMMARY OF THE INVENTION

Accordingly, a concrete module and method for making the module and structures using the modules are provided. The concrete module includes a concrete shell, buoyant core and passages through the module for interconnecting two or more modules using connecting rods, cables or other means. The modules are shaped to allow contact along the vertical edges of abutting modules. Reinforcing concrete ribs in the top and side surfaces of the module are provided to add strength and rigidity to the module. Locking keys and locking keyholes incorporated into the sides of the module aid in aligning the modules when assembling a structure and help transfer loads between modules to strengthen and stiffen the structure.

The module is fabricated up side down in a mold. The mold incorporates beveled or radius corners which are transferred to the perimeter of the top surface and sides of the module. The mold also uses removable core rods to form the concrete passages through the module and to center the buoyant core within the concrete shell of the module. Fabrication of the module up side down eliminates the need to hand finish the top surface of the module and gives a finished casted texture to the surface or top of the module.

Modules are assembled together to form a floating structure by aligning the locking keys and keyholes of adjacent modules and inserting interconnecting rods or other interconnecting means through the aligned passages. Brackets are connected to the outside ends of the interconnecting rods to distribute the load from structures attached to the brackets to the rods or over a larger surface area of the modules.

Other advantages of this invention will become apparent from the following description taken in connection with the accompanying drawings, wherein is set forth by way of illustration and example, a preferred embodiment of the present invention.

DETAILED DESCRIPTION

Figure 2:
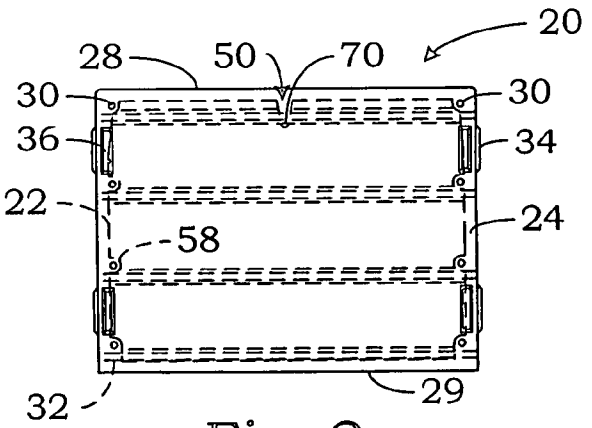
FIG. 2 is a front elevational view of the concrete module of FIG. 1.
Figure 3:
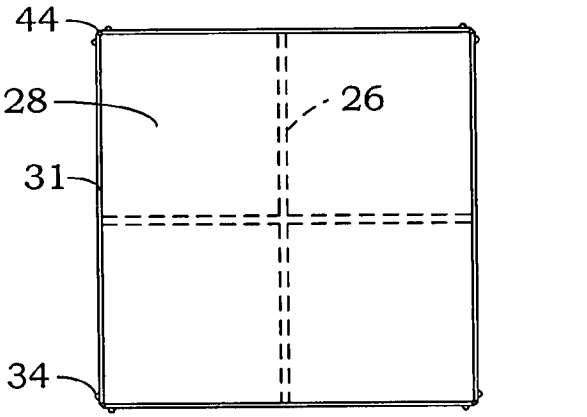
FIG. 3 is a top plan view of the concrete module of FIG. 1.
Figure 1:
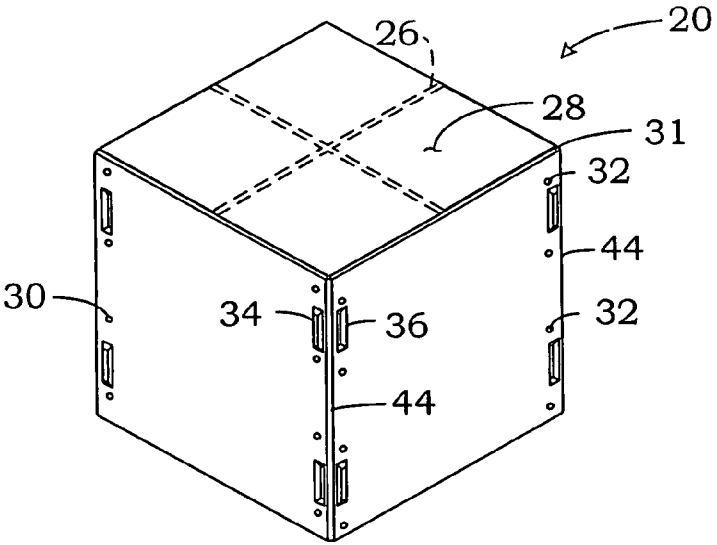
FIG. 1 is a perspective view of the concrete module of the present invention.

Referring to FIGS. 1–3, a concrete module of the present invention is generally indicated by reference numeral 20. Module 20 includes a buoyant center core 22 with a concrete outer shell 24, reinforcing ribs 26 under the top surface 28 of concrete shell 24 and a bottom surface 29. Reinforcing ribs 26 provide additional strength to the top of module 20. The top and side edges 31 of module 20 are rounded or angled.

The module 20 includes a first set of frame rode or cable passages 30 which extend from the front to the rear of the module 20 along a first set of spaced-apart planes generally parallel to the top surface 28 of concrete shell 24. A second set of frame rod or cable passages 32 extend between the sides of the module 20 along a second set of spaced-apart planes generally parallel to the top surface 28 of concrete shell 24.

Figure 12:
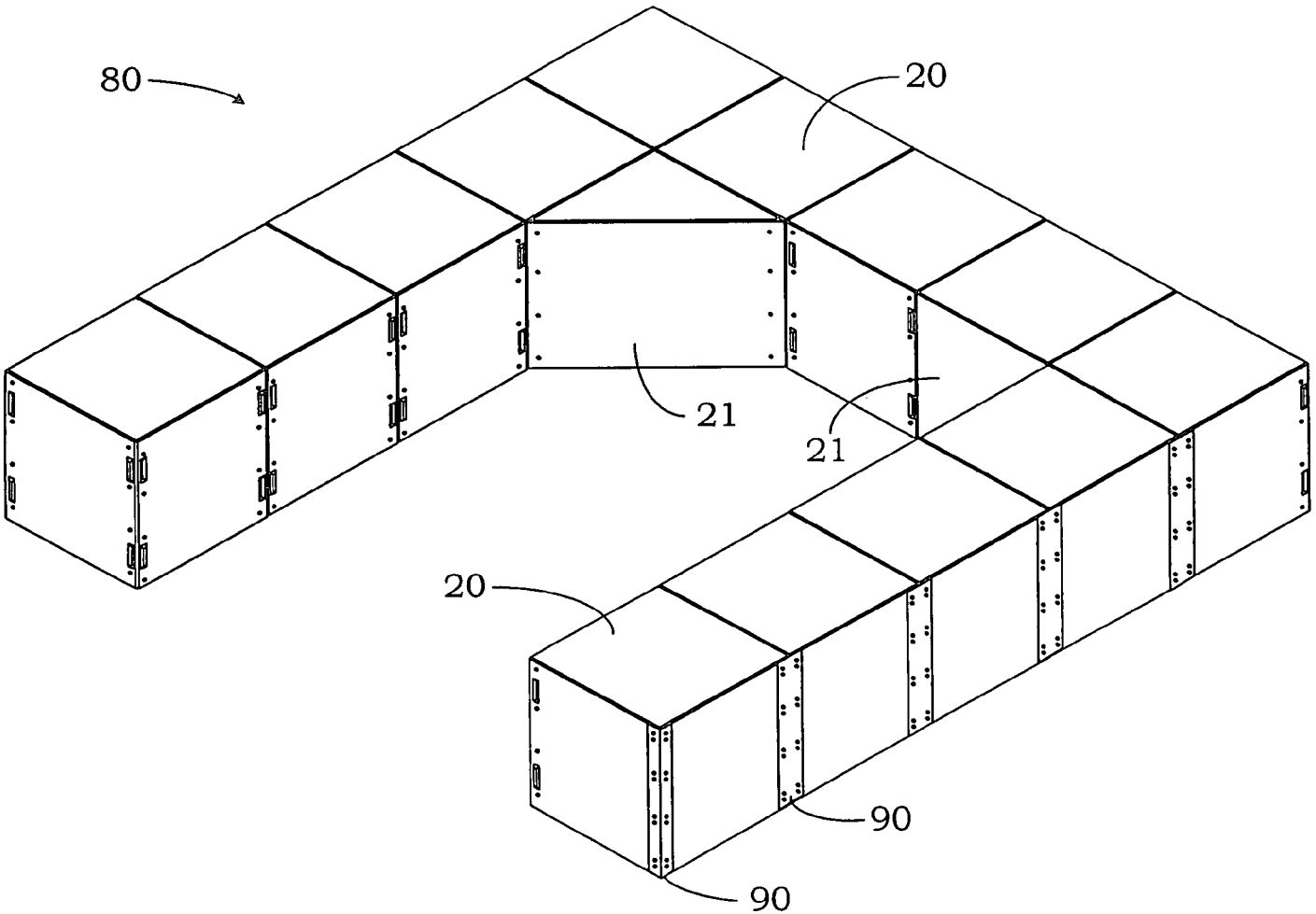
FIG. 12 is a perspective view of a floating structure made with a plurality of concrete modules of FIG. 1.
Figure 14:
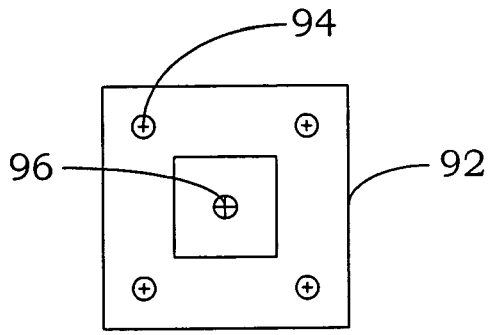
FIG. 14 is a top plan view of a bottom plate used with a floating structure made with modules of the present invention.
Figure 13:
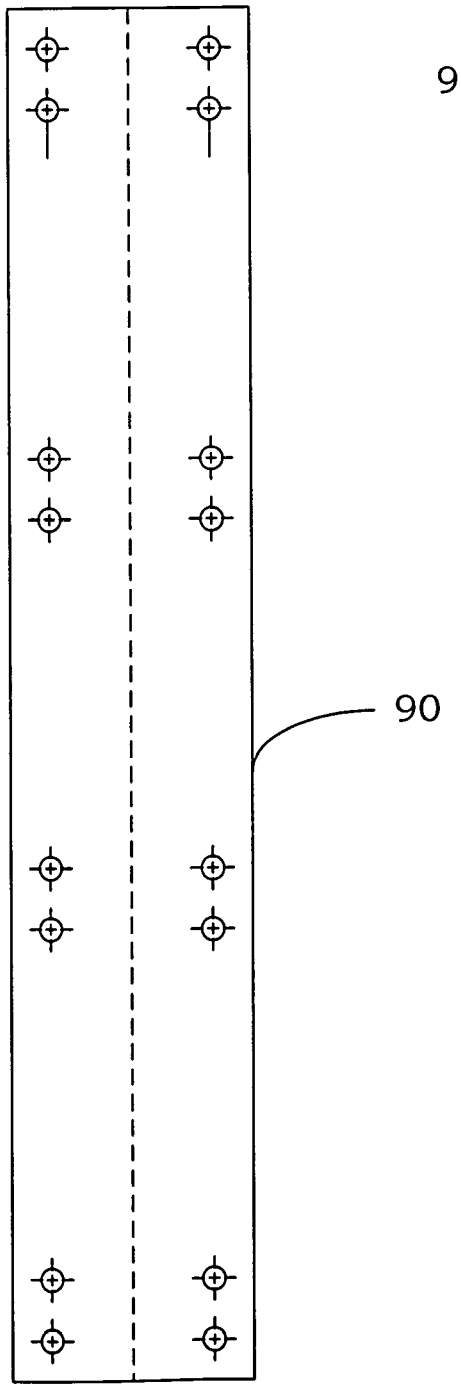
FIG. 13 is a front elevational view of a major flat bracket used with a floating structure made with modules of the present invention.

The vertical surfaces of concrete shell 24 include spaced-apart locking keys 34 and matching locking keyholes 36. The locking keys 34 and locking keyholes 36 are positioned so as to be aligned when two or more modules 20 are interconnected to form a floating structure 80 (FIG. 12). The locking keys 34 and locking keyholes 36 aid in aligning the modules 20 and the frame rod passages 30 and 32 during assembly of a floating structure of modules 20 and interlock within the floating structure to help hold the structure together by maintaining the modules 20 in horizontal and vertical alignment. A plurality of modules 20 may be connected together with an interconnecting means such as rods or cables which pass through passages 30 and 32. Connection of the modules 20 is described in detail below.

Figure 5:
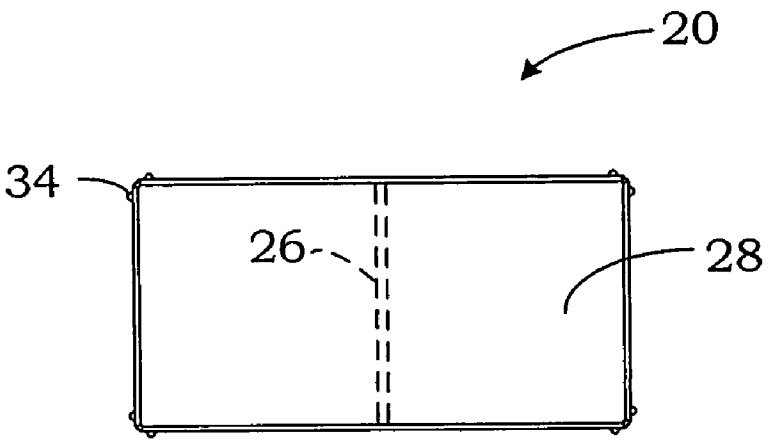
FIG. 5 is a top plan view of the rectangular concrete module of FIG. 5.
Figure 4:
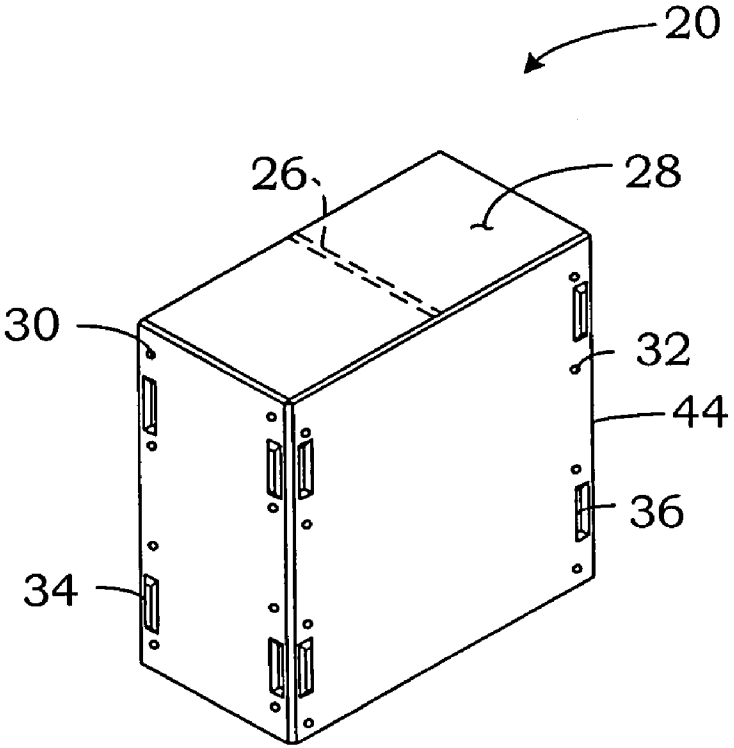
FIG. 4 is a perspective view of a rectangular concrete module of the present invention.

In the preferred embodiment, module 20 may be forty-eight inches wide by forty-eight inches deep by thirty-six inches high. Another common size for module 20 is twenty-four inches wide by forty-eight inches deep by thirty-six inches high as shown in FIGS. 4 and 5. The size of module 20 allows for transportation using standard hauling trucks and placement or moving with skid loaders and fork lifts. The modules 20 have common sizes and connecting passages 30 and 32 that are uniform to allow custom designed docks and other floating structures.

Figure 6:
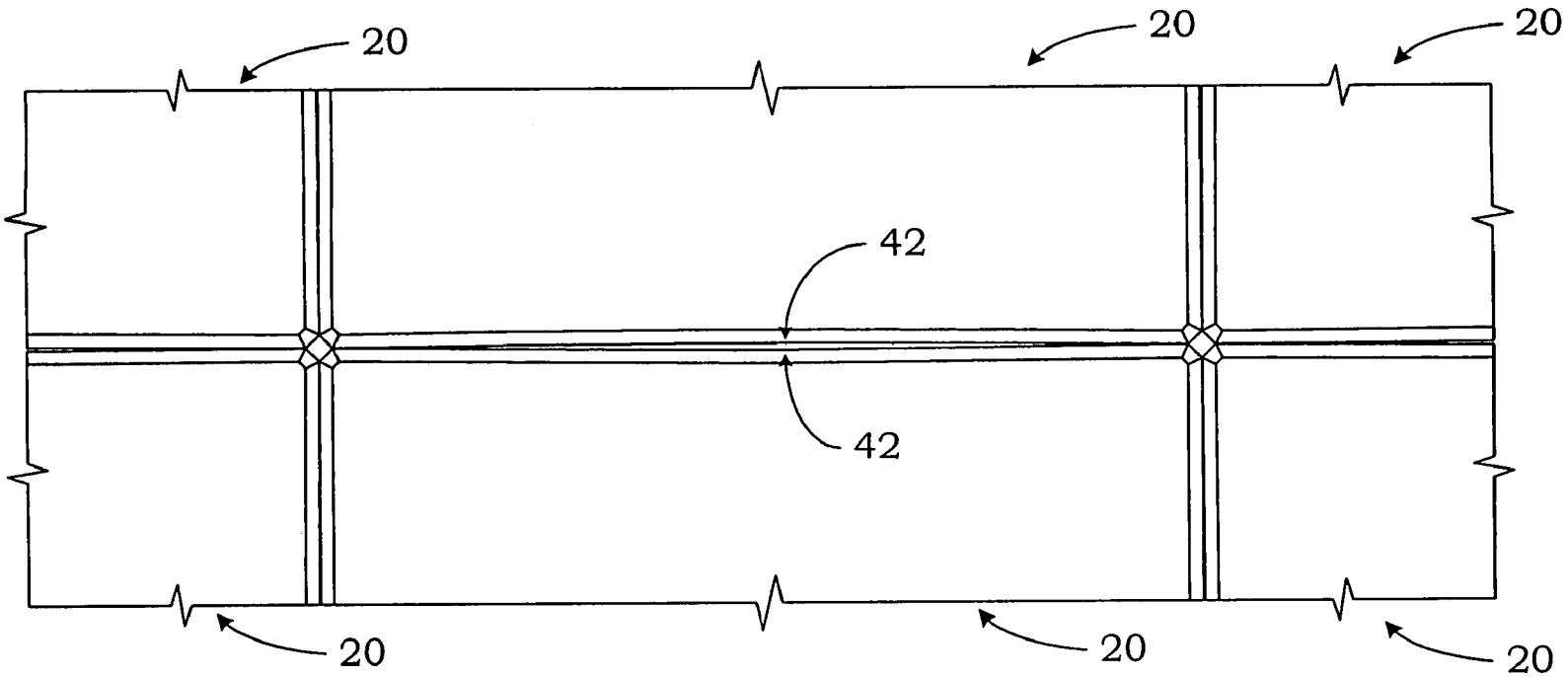
FIG. 6 is a partial top plan view illustrating the interface between six concrete modules.
Figure 9:
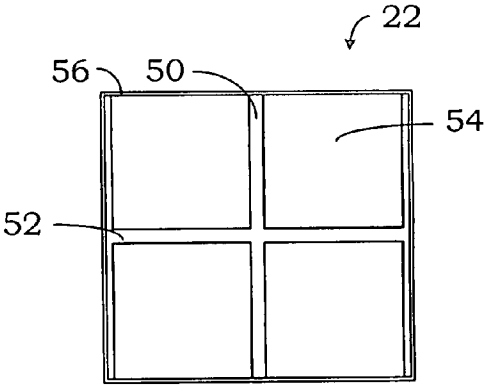
FIG. 9 is a top plan view of the buoyant core of FIG. 7.
Figure 10:
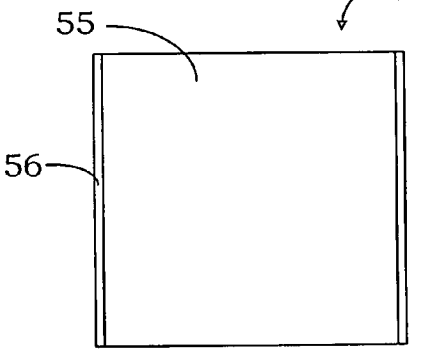
FIG. 10 is a bottom plan view of the buoyant core of FIG. 7.
Figure 7A:
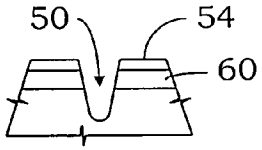
FIG. 7*a* is a detail view of a notch in the top surface of the buoyant core of FIG. 7.
Figure 7B:
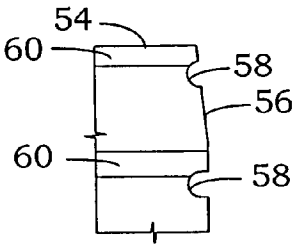
FIG. 7*b* is a detail view of the grooves in the side surfaces of the buoyant core of FIG. 7.
Figure 8A:
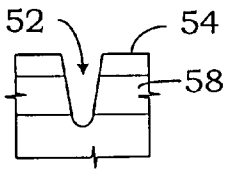
FIG. 8*a* is a detail view of a notch in the top surface of the buoyant core of FIG. 8.
Figure 7:
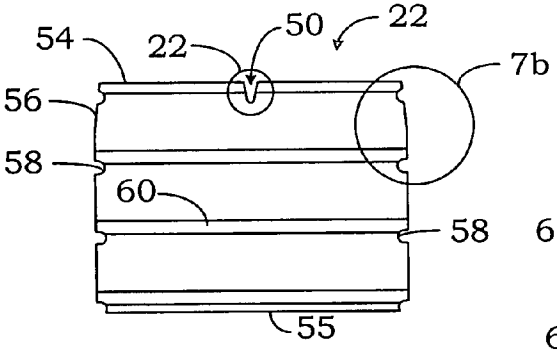
FIG. 7 is a front elevational view of the buoyant core of the concrete module of FIG. 1.
Figure 8:
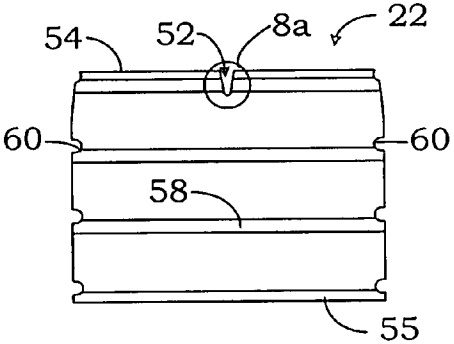
FIG. 8 is a side elevational view of the buoyant core of FIG. 7.

Referring to FIGS. 1 and 6, a partial plan view of six interconnected modules 20 is shown (FIG. 6). The vertical sides of module 20 may be slightly concave as generally indicated by reference numeral 42 to allow the modules to abut one another along the vertical edges 44 of module 20 at the corners. The amount of concavity indicated by reference numeral 42 is exaggerated for clarity. In the preferred embodiment, the vertical sides of module 20 may have a curvature of one sixteenth of an inch over forty-eight inches. Thus, the separation between modules 20 at their midpoint may be one eighth of an inch.

A flexible gasket material such as silicon (not shown) may be added to the inside of locking keyholes 36 to make the transfer of tension and pressure in compression forces between modules 20 more uniform. A gasket material may also be added to the vertical edges 44 of the modules 20 along the line of contact between modules.

The buoyant core 22 may be made or formed from a block of expanded polystyrene or other foam material. Expanded polystyrene displaces water, does not allow water within the buoyant center region occupied by core 22 within concrete shell 24, and generally does not absorb water or deteriorate when exposed to water. A hollow center, such as a hollow plastic block or other similar structure and arrangement, could also be used.

The concrete shell 24 has side thickness of approximately one and one-half inches. Thus the dimensions of the buoyant core 22 are approximate forty-five inches wide by forty-five inches deep by thirty-three inches high for a standard size module 20.

The height of the buoyant core 22 may vary depending on live weight or dead weight at the particular location of the module 20 in the overall floating structure. The buoyant core 22 provides the buoyancy needed to float the entire module 20 along with any other live and/or dead weight such as people, roofs, snow, ice, buildings, and other items and objects. Generally, the greater the height of the module 20 the more buoyant the module 20. As such, the particular location of the module in the floating structure may determine what height module 20 will be used. A light-weight concrete may also be used to provide more buoyancy to the dock where needed.

A standard module 20, which is the primary module used throughout constructing most of a floating structure, has a height of approximately thirty-six inches. In locations where buildings, posts for roofs, or any other objects exerting an above average weight on a continuous basis are located, modules 20 with heights greater than thirty-six inches may be used. These types of locations require a higher degree of floatation due to the greater than average load on these modules 20. Without the greater height additional stresses are placed on the interconnecting rods or cables to distribute the load to adjoining modules 20. It is the plurality of modules 20 interconnected together that provides the stability and the desirable features of a floating structure 80 (FIG. 12).

Increasing the height of the buoyant core 22 and thus module 20 provides extra floatation to support any added weight, which in turn relieves stress on the interconnecting means and the adjoining modules 20. The exact measurements of the core 22 and module 20 may vary depending on the particular application, type of materials being used, the configuration of the modules 20 in the floating structure, and the degree of buoyancy needed for the weight.

The basic module 20 is generally rectangular in shape. Other shapes are also considered within the scope of this invention. A triangular shaped module (21, FIG. 12) may be provided for interior corners to reinforce and add strength to the overall floating structure or for aesthetic purposes. In addition, triangular shaped modules, when used in opposing pairs at the front of a boat slip, may be used to form a boat bow receiving area. This reduces the open area along the front of a boat when docked in the slip. These other shaped modules 10 have all the features of the basic module 10. The only difference is the number of sides.

Referring to FIGS. 7–10, the buoyant core 22 is illustrated. The buoyant core 22 may include a first 50 and a second 52 notch in a top surface 54. When filled with concrete, the notches 50 and 52 form reinforcing ribs 26 (FIGS. 1 and 3). Notches 50 and 52 are generally perpendicular to one another and intersect generally in the center of the top surface 54 of buoyant core 22. Notches 50 and 52 are sized approximately two inches wide at the top, two inches deep and taper to one inch at the bottom. Core 22 includes a tapered side portion 56 near the top 54 to allow for additional concrete in this area of the shell 24 when module 20 is formed for added strength.

Buoyant core 22 includes grooves 58 and 60 along the sides of the core 22. The grooves 58 and 60 provide a path for forming the first and second sets of passages 30 and 32 (FIG. 1) through module 20. All of the grooves 58 and 60 are generally parallel to the top surface 54 and bottom surface 55 of core 22. Grooves 58 are uniformly spaced along the sides of core 22. Grooves 60 are also uniformly spaced along the sides of core 22 and offset from grooves 56 by approximately one and one-half inches.

In a four-sided core 22, there are sixteen grooves, four on each vertical side of core 22. Groove 58 along with the corresponding groove 58 on the opposite side of core 22 define a plane which is parallel to the top surface 54 of core 22. Each of the four grooves 58 on one side of core 22 has a corresponding groove 58 on the opposite side of core 22, each pair defining a plane generally parallel to the top surface 54 of core 22. Likewise, each groove 60 on one side of core 22 has a corresponding groove 60 on the opposite side of core 22, each pair of grooves defining a plane generally parallel to the top surface of core 22. The planes defined by grooves 58 and the planes defined by grooves 60 are non-common generally parallel planes.

The buoyant core 22 may be cut from a bulk block of expanded polystyrene. Typically two or more buoyant cores 22 may be cut from a single bulk block of polystyrene. The buoyant core 22 may be cut into the proper dimensions with notches 50 and 52, grooves 58 and 60, tapered top portion 56. The core 22 may be cut using any method such as a heated wire cutting tool for example.

Figure 11:
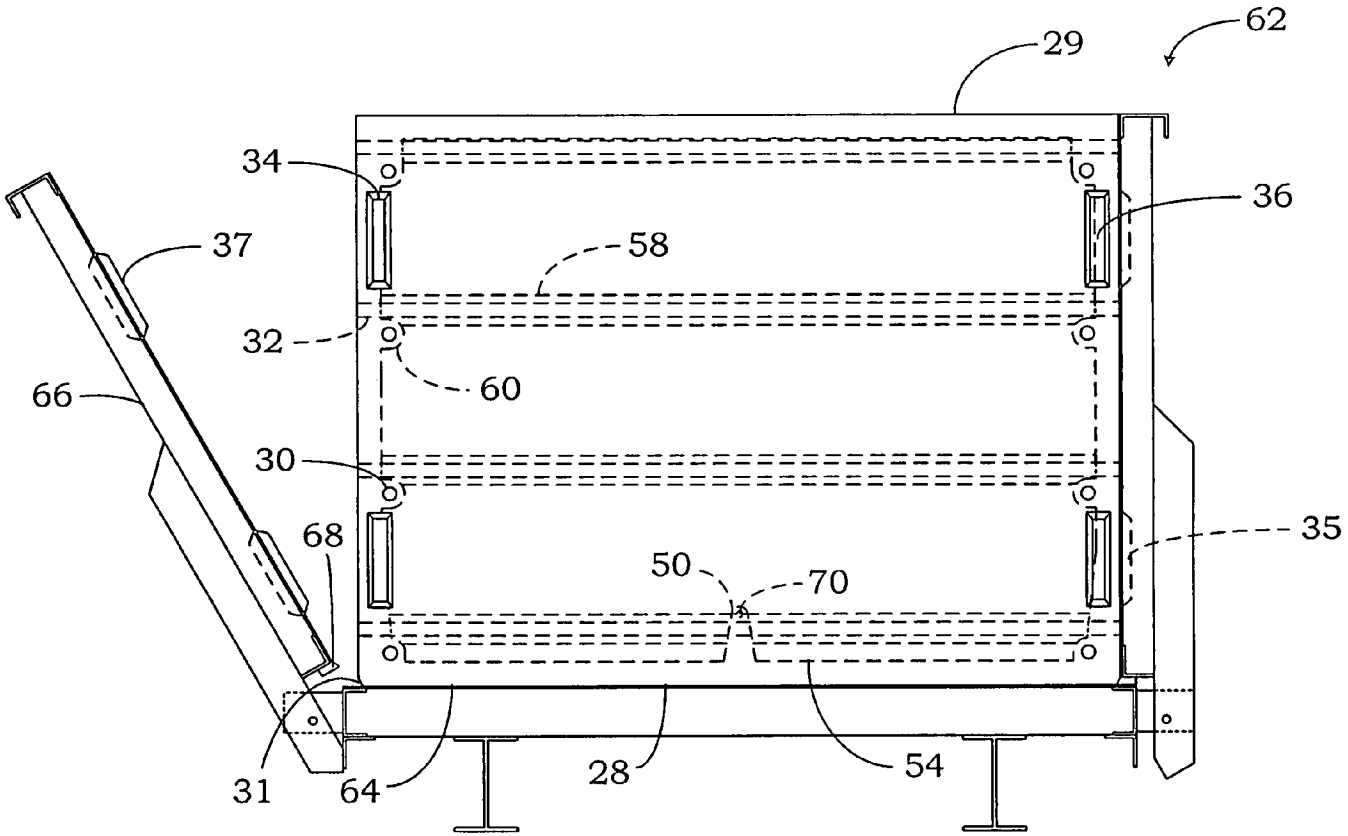
FIG. 11 is a front elevational view of the fabrication mold for the concrete module of FIG. 1 shown with the front panel removed.

Referring to FIG. 11, a mold 62 for forming module 20 is illustrated. Mold 62 includes a bottom plate 64 and hinged sides 66. As illustrated, the front side of mold 62 is removed in order to better illustrate and show the other components and features of mold 62 and module 20.

Module 20 may be formed upside down which allows the top surface 28 of shell 24 to include a precast flat textured top surface 28 (FIG. 1) with beveled or radiused edges. Bevels 68 at the bottom sides 66 of mold 62 form the beveled edges of module 20. Sides 66 also include forms 35 and 37 for the locking keys 34 and locking keyholes 36. Only keyholes 36 may be cast into the sides of a module with loose two-sided keys (not shown) cast separately. The keyholes of abutting modules may then be aligned and the two-sided keys inserted to the facing keyholes.

Typically, reinforcing rods 70 may be positioned in the notches 50 and 52 of core 22 prior to placement in the mold 62. Any type of reinforcing rods 70 may be used which provide adequate strength to the ribs 26 (FIG. 1) such as a standard metal reinforcing rod ⅜ inches in diameter and cut to a length just slightly shorter than the length of the notches 50 and 52. The notches 50 and 52 containing the reinforcing rods 70 and filled with concrete, form reinforcing ribs 26. The reinforcing ribs 26 are integrated and formed with the concrete shell 24 and are positioned within the top surface of the module 20.

The reinforcing ribs 26 provide strength for the top surface 28 of module 20. Since the typical module 20 is four feet across the reinforcing ribs 26 provide significant strength to prevent the concrete from breaking under heavy weight. Any number of reinforcing ribs 16 could be added if necessary.

A module 20 is formed by first cleaning the interior surfaces of mold 62 and oiling the surfaces with a concrete release coat. A pre-trimmed foam core 22 and two reinforcing rods 70 are placed upside down in mold 62. The sides 66 of mold 62 are closed, sealed and tightened down with clamps. Sixteen core rods (not shown) are inserted through holes in the sides 66 of the mold 62 which are in axial alignment with the grooves 58 and 60 in core 22.

Concrete is added to the mold 62. Mold 62 is vibrated around all six sides. Spacers (not shown) may be used along with the core rods (not shown) to maintain the foam core 22 in the correct position as the concrete is poured into the mold 62 and vibrated. Vibrating the mold 62 helps eliminate any air pockets or voids in the concrete and increases the density of the concrete at the bottom of the mold 62 which results in a stronger and denser upper surface 28 of module 20.

The concrete is a standard Portland mix with aggregate stones, sand and fibers. Other concrete such as light weight concrete using expanded shale aggregate may be used to form concrete shell 24. Other methods of reinforcing the concrete may be used such as incorporating reinforcing rods, metal screen or woven wire, fiberglass meshes and various types of fibers added to the concrete.

The concrete used to make the concrete shell 24 may be reinforced with a fibrillated fiber made with polypropylene. The polypropylene fibers help strengthen the concrete, are water resistant and do not rust or deteriorate when exposed to water for long periods of time.

Once the mold 62 is vibrated and the concrete settles, the top of the concrete is scraped flush with to top of mold 62 forming the bottom surface 29 of module 20. The concrete at the top of the mold 62 does not have to be hand tooled and finished because it is the bottom of the concrete module 20, which saves time and labor during fabrication of module 20. The core rods (not shown) are removed after the concrete has reached a semi-plastic condition and will hold its shape after the core rods are removed. As the rods are removed, they can be rotated and pulled back and forth to smooth the inside of the passages 30 and 32. The smooth surfaces help prevent erosion of connecting rods and cables due to rough surfaces. Typically, a passage forming rod has an outside diameter of approximately ⅞ inch which provides passages 30 and 32 having an inside diameter of approximately the same dimension. As such, an interconnecting rod or cable of up to approximately ⅞ inch in diameter may be used to connect the modules 20.

The concrete module 20 is removed from mold 62 after approximately twenty-four hours depending on the temperature, humidity and other curing conditions. The modules 20 are placed right side up and are ready for use or storage. Additional hardening systems may be used to increase the strength of the concrete.

When module 20 is formed, concrete in the grooves 58 and 60 form horizontal ribs around the module 20 and provide for the concrete passages 30 and 32 through module 20. The horizontal concrete ribs in combination with an interconnecting rod or cable through passages 30 and 32 which are tightened and thus under tension when the modules 20 are fastened together, result in a pre-stressed beam which is very rigid and strong. The resulting structure 80 is solid with little flex.

Referring to FIG. 12, modules 20 are designed to be used with a plurality of modules 20 interconnected to form a floating platform or structure 80. The floating structure 80 built with interconnecting modules 20 provides a flat rigid structure with a high degree of stability.

Figure 15A:
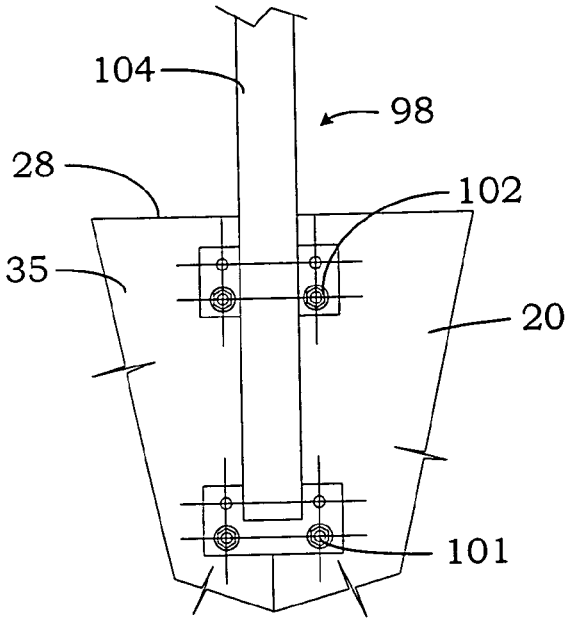
FIG. 15*a* is a front elevational view of a side mount bracket used with a floating structure made with modules of the present invention.
Figure 16A:
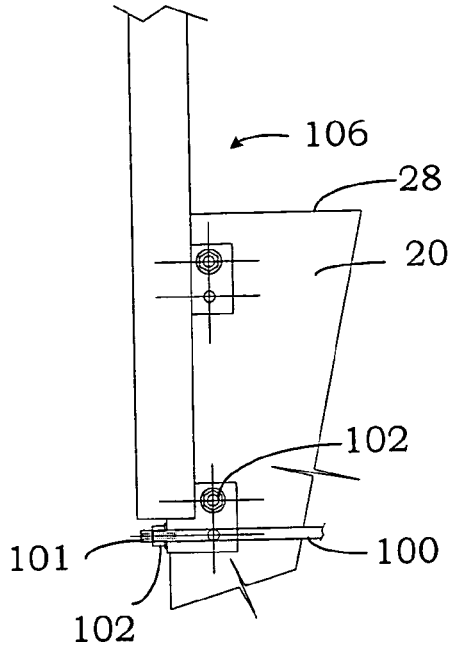
FIG. 16*a* is a front elevational view of an outside corner mount bracket used with a floating structure made with modules of the present invention.
Figure 15B:
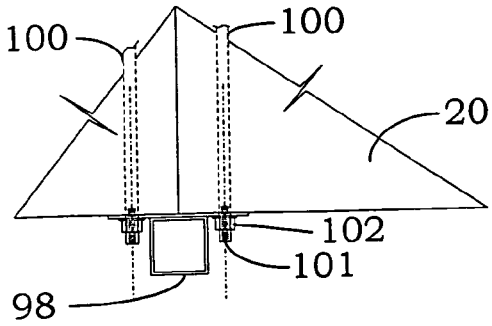
FIG. 15*b* is a top plan view of the side mount bracket of FIG. 15*a*.
Figure 16B:
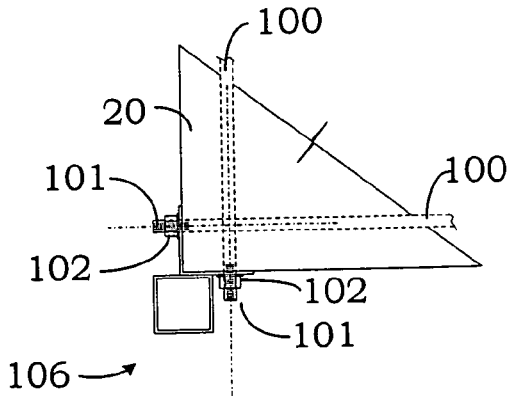
FIG. 16*b* is a top plan view of the outside corner mount bracket of FIG. 16*a*.
Figure 17A:
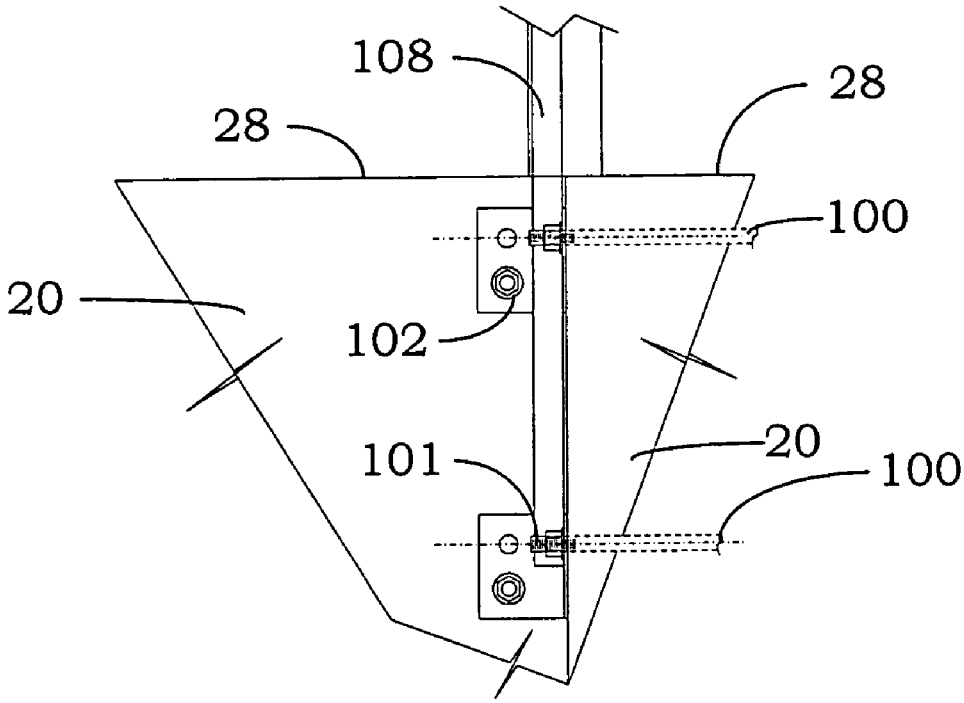
FIG. 17*a* is a front elevational view of an inside corner mount bracket used with a floating structure made with modules of the present invention.
Figure 17B:
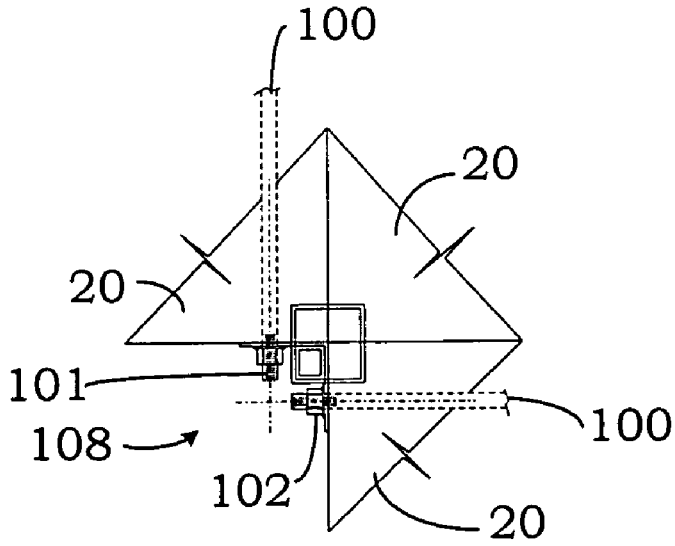
FIG. 17*b* is a top plan view of the inside corner mount bracket of FIG. 17*a*.

The interconnecting rods or cables may be used to connect a plurality of modules 20 together to form a floating structure 80. Other interconnecting means may used such as chain or similar connecting apparatuses or devices. In the preferred embodiment, rods 100 with threaded ends 101 are used (see FIGS. 15–17). Rods 100 add rigidity to the structure 80, may be made in any length on location or at a factory, generally do not stretch as does a chain or cable when under tension for long periods of time, and any excess may be readily and easily trimmed. Typically, steel rods 100, or interconnecting means of the desired length are inserted through the passages 30 and 32 on the modules 20 to be interconnected. A nut 102 (FIGS. 15–17) is screwed onto one of the threaded ends 101. The modules 20 are then positioned tightly against one another using locking keys 34 and locking keyholes 36 to align the modules 20. A second nut (not shown), is then screwed onto the other threaded end to place tension on the rod 100 and to hold the modules 20 tightly against one another. As all the interconnecting rods 100 are secured and tightened, the floating structure 80 becomes rigid and stable. The horizontal concrete ribs in combination with an interconnecting rod or cable through passages 30 and 32 which are tightened and thus under tension when the modules 20 are fastened together, result in 16 steel-reinforced pre-stressed concrete beams per module, which are very rigid and strong.

In a typical application, the size of the structure 80 to be assembled is predetermined. Thus the rods 100 may be precut to the necessary lengths. All steel components including the rods 100, nuts 101 and brackets (FIGS. 13–17) are hot dipped galvanized produced by immersion in a molten bath of zinc. The threaded ends 101 of rods 100 are under-threaded to allow build up of zinc. After being galvanized, the rod ends 101 are rethreaded to the proper thread size or cleaned as necessary for nuts 102. In this way, the zinc layer is not removed when the nuts 102 are installed on the rod ends 101.

In accordance with the features of the module 20 of this invention, the interconnecting rods or cables 100 are in non-common planes through passages 30 and 32. This arrangement places two rods 100 or interconnecting means in each of the eight planes defined by the pairs of opposing passages 30 and 32. This arrangement and location of the interconnecting rods 100 secure the modules 20 against one another with little flexing and bowing. Because of the curved sides of the modules 20, the modules 20 contact one another evenly along the vertical edges.

A variety of brackets is shown in FIGS. 13–17. All brackets are made of steel components which are hot dipped galvanized. The brackets are used for a variety of different purposes. One type of bracket 90 is used at the ends of interconnecting rods 100 extending from the vertical surfaces of abutting modules 20. The bracket 90 is basically a rectangular plate having apertures corresponding to the locations of passages 30 and 32 on modules 20. The bracket 90 is used on the outside of the modules 20 along the seam between two abutting modules to transfer tension from the fame rods or cables 100 to a larger surface of the concrete module 20. Bracket 90 may also be configured as a ninety degree or right angle bracket for application to either an outside or inside corner of modules 20 and floating structure 80. Locking keys 34 extending from the side of a module 20 that interfere with the installation of any bracket may be removed with a hammer and brick set. Locking keyholes may be covered with a bracket.

Bracket 92 may be used to anchor a vertical post to module 20. Holes 94 in bracket 92 provide a means to anchor the bracket to a module 20 with anchor bolts or concrete screws. Bracket 92 also includes a drain hole 96 to allow water to drain from a hollow steel post, for example.

Side mount bracket 98 is attached to a pair of abutting modules 20 with the frame rods 100 and nuts 102. The upright post 104 extends above the top surface 28 of module 20. An outside corner mount bracket 106 and an inside corner bracket 108 are also shown.

Brackets attached using the frame rods 100 and nuts 102 are the preferred method of attaching roof uprights, ramps, stiff arms, boat lifts, corner bracing or other features for example. The brackets transfer forces, weight and impact stresses from any structure directly to the modules 20 through the frame rods 100

At the job site, the modules 20 are placed in the water. A plurality of the modules 20, as dictated by the desired configuration, are positioned in line and aligned using the locking keys 34 and locking keyholes 36. An interconnecting rod 100, cable or other interconnecting means, is inserted through the passages 30 or 32 in the plurality of modules 20. A nut 102 is typically placed on one end of the rod 100 to prevent the rod 100 from being pulled from the modules 20 as other modules 20 are added. Once the line is formed a second nut is added to the opposite end of rod 100 to prevent the modules 20 from separating. A second line is similarly constructed along side the first. After the second line is assembled, other interconnecting rods may be inserted through the other set of passages 30 or 32 to interconnect the modules 20 in the other direction. Modules 20 are then added to form the desired configuration.

At the intersection of the abutting modules 20, where no structure or other item is to be attached, bracket 90 is added and attached in conjunction with the interconnecting rods 100 and nuts 102. At the corners where no structure is positioned or no other item is to be attached, a ninety degree corner bracket 90 is added in conjunction with the interconnecting rods 100 and nuts 102. At corners or the intersection of two modules 20 where posts are required, brackets 98, 104 or 106 may be installed in conjunction with the interconnecting rods 100 and nuts 102.

Once all the modules 10 are positioned and attached, the interconnecting means can be completely tightened. Using rods 100 with threaded ends 102 makes this task very easy. The nuts 102 are simply tightened to draw the modules 20 together.

It is to be understood that while certain now preferred forms of this invention have been illustrated and described, it is not limited thereto except insofar as such limitations are included in the following claims.

What is claimed is:

1. A concrete module for assembling floating structures comprising:

a module having a buoyant core surrounded by a concrete shell, said module having a top, at least three sides and a bottom with a plurality of said modules adapted to be interconnected to present a floating structure;

one or more sides of said module having a curved surface such that vertical edges of said side of said module can butt against vertical edges of a facing side of an adjoining module and presenting a vertical gap in a center area of the abutting modules;

a first pair of passages for receiving a first pair of interconnecting members through said module in a first plane, said first plane below and generally parallel to an upper surface of said top of said module; and a second pair of passages for receiving a second pair of interconnecting members through said module in a second plane, wherein said second pair of passages are generally transverse to said first pair of passages, and said second plane is below and generally parallel to said first plane.

2. The concrete module as set forth in claim 1 further comprising one or more locking keys extending from one or more of said sides of said module along a vertical edge of said sides and one or more locking keyholes in one or more of said sides of an adjoining module generally aligned with said locking keys.

3. The concrete module as set forth in claim 1 further comprising one or more locking keys extending from one or more of said sides of said module along a vertical edge of said sides, and one or more locking keyholes in one or more sides of said module along said vertical edge of said sides.

4. The concrete module as set forth in claim 3 wherein said locking keys and locking keyholes along a vertical edge of said side are generally vertically aligned.

5. The concrete module as claimed in claim 4 wherein said one or more locking keys of a module are generally vertically and horizontally aligned with one or more locking keyholes of an adjoining module.

6. The concrete module as set forth in claim 1 wherein said buoyant core is made of a block of expanded polystyrene.

7. The concrete module as set forth in claim 1 wherein said buoyant core includes at least two notches in a top surface of said buoyant core, said notches for receiving reinforcing rods and concrete to form reinforcing ribs.

8. The concrete module as set forth in claim 1 wherein said buoyant core has beveled or rounded corners and a tapered upper portion along sides of said buoyant core, said beveled or rounded corners and tapered side portion providing extra strength for said concrete shell.

9. The concrete module as set forth in claim 1 wherein said buoyant core has grooves along said sides, said grooves presenting a path for forming said first and second passages.

10. The concrete module as set forth in claim 1 further comprising a plurality of brackets, said brackets used to attach items and other structures to a floating structure made with said concrete modules, and to provide protection of said concrete shell and add strength to said floating structure.

11. The concrete module as set forth in claim 1 wherein said buoyant core includes a first plurality of pairs of horizontally aligned grooves along a first pair of opposite sides of said buoyant core, and a second plurality of pairs of horizontally aligned grooves along a second pair of opposite sides, wherein each of said pairs of horizontally aligned grooves lie in separate and generally parallel horizontal planes.

12. The concrete module as set forth in claim 11 wherein one or more of said grooves includes a passage for receiving an interconnecting member through said module.

13. A concrete module for assembling floating structures comprising:

a buoyant core having a top, three or more sides, a bottom and one or more chamfered or rounded corners, said sides having a tapered upper portion and one or more grooves generally parallel with said top, said top having one or more notches, a concrete shell surrounding said buoyant core, one or more sides of said concrete shell curving inwardly and presenting generally coplanar vertical edges such that said vertical edges of a side of said concrete shell abut vertical edges of a facing side of an adjoining concrete module and presenting a vertical gap between the adjoining modules, two or more passages through said module with said passages corresponding to said grooves in said buoyant core with at least one of said passages in each of two non-common planes, said planes being generally parallel with a top surface of said concrete shell;

one or more locking keys extending from one or more sides of said module;

one or more locking keyholes in one or more sides of said modules; and an interconnecting means extending through said passages to join a plurality of said modules together to form a floating structure;

whereby said locking keys of one of said plurality of said modules are aligned with said locking keyholes of another module abutting along a side of said one of said plurality of modules.

14. The concrete module as set forth in claim 13 in which said buoyant core is formed from expanded polystyrene.

15. The concrete module as set forth in claim 13 in which said concrete shell is made with a reinforced concrete.

16. The concrete module as set forth in claim 13 in which said concrete shell is made with a lightweight reinforced concrete.

17. The concrete module as set forth in claim 13 in which said concrete shell is made using concrete with an expanded shale aggregate.

18. The concrete module as set forth in claim 13 in which said concrete shell is made with concrete reinforced with a fibrillated fiber.

19. The concrete module as set forth in claim 13 further comprising one or more reinforcing ribs, said reinforcing rib being made with a reinforcing rod and concrete within said notches in said top surface of said buoyant core, said reinforcing rib being continuous and integrated with said concrete shell to provide extra strength to said top surface of said module.

20. The concrete module as set forth in claim 13 wherein said interconnecting means comprises a rod with threaded ends, said rod extending through said passages to interconnect and join a plurality of modules together to form a floating structure, and nuts on said threaded ends to secure said modules to said interconnecting means.

21. The concrete module as set forth in claim 13 wherein said interconnecting means comprises a cable with threaded ends, said cable extending through said passages to interconnect and join a plurality of modules together to form a floating structure, and nuts on said threaded ends to secure said modules to said interconnecting means.

22. The concrete module as set forth in claim 13 further claiming a plurality of different shaped brackets, said brackets provided for attaching other structures and items to said floating structure made with said module, for providing protection to said modules at said passages and to add strength to said floating structure at an intersection between two of said modules.

23. The concrete module as set forth in claim 13 wherein said buoyant core includes a first plurality of pairs of horizontally aligned grooves along a first pair of opposite sides of said buoyant core, and a second plurality of pairs of horizontally aligned grooves along a second pair of opposite sides, wherein each of said pairs of horizontally aligned grooves lie in separate and generally parallel horizontal planes.

24. The concrete module as set forth in claim 22 wherein one or more of said grooves includes a passage for receiving an interconnecting member through said module.

25. A mold for forming a concrete module for a floating structure comprising:

a bottom plate for forming a top surface of the concrete module;

at least three side plates each secured along a lower edge to said bottom plate;

said lower edge of said side plates each having a bevel extending inwardly toward a center portion of said bottom plate;

said side plates each having two vertical edges and a vertical surface curved inwardly toward a center area of said mold;

said vertical edges of a side plate abutting adjacent vertical edges of an adjacent side plate to form an enclosure.

26. The mold as set forth in claim 25 further comprising an at least one key form extending outwardly from each of said side plates proximal a vertical edge and an at least one keyhole form extending inwardly from each of said side plates proximal a vertical edge of said side plate.

27. The mold as set forth in claim 26 wherein said at least one lock key form and said at least one lock keyhole form proximal a vertical edge are generally vertically aligned.

28. The mold as set forth in claim 25 wherein said side walls include one or more vertically spaced apart apertures proximal said vertical edges and in axial alignment with an aperture in an opposing side wall.

29. A method of forming a concrete module for assembling floating structures comprising the steps of:

cleaning the interior surfaces of a mold having a bottom and at least three sides, oiling the interior surfaces with a concrete release coating, placing a pre-trimmed foam core upside down in said mold, inserting core rods through apertures in said sides which are axially aligned with apertures in opposite sides of said mold and grooves in said foam core, adding concrete to said mold over and around said foam core, vibrating the sides of said mold, scraping the concrete flush with the top edges of the sides of the mold to finish the bottom surface of the concrete module, removing the core rods after the concrete has reached a semi-plastic condition, removing the concrete module from the mold and placing the concrete module right side up for use or storage after the concrete cures.

* * * * *